US010109412B2

(12) United States Patent
Hatakeyama

(10) Patent No.: US 10,109,412 B2
(45) Date of Patent: Oct. 23, 2018

(54) COIL PART AND METHOD OF MANUFACTURING COIL PART

(71) Applicant: SUMIDA CORPORATION, Chuo-Ku, Tokyo (JP)

(72) Inventor: Takeshi Hatakeyama, Natori (JP)

(73) Assignee: SUMIDA CORPORATION, Tokyo (JP)

( * ) Notice: Subject to any disclaimer, the term of this patent is extended or adjusted under 35 U.S.C. 154(b) by 0 days.

(21) Appl. No.: 15/439,311

(22) Filed: Feb. 22, 2017

(65) Prior Publication Data

US 2017/0243693 A1 Aug. 24, 2017

(30) Foreign Application Priority Data

Feb. 24, 2016 (JP) ..... 2016-033431

(51) Int. Cl.

| | |
|---|---|
| ***H01F 21/06*** | (2006.01) |
| ***H01F 27/02*** | (2006.01) |
| ***H01F 17/04*** | (2006.01) |
| ***H01F 21/04*** | (2006.01) |
| ***H01F 27/32*** | (2006.01) |
| ***H01F 41/06*** | (2016.01) |

(52) U.S. Cl.

CPC ..... *H01F 27/325* (2013.01); *H01F 41/06* (2013.01)

(58) Field of Classification Search

USPC ..... 336/118–119, 128, 129, 221

See application file for complete search history.

(56) References Cited

U.S. PATENT DOCUMENTS

| | | | | |
|---|---|---|---|---|
| 2,628,342 | A * | 2/1953 | Taylor | H04M 1/02 336/107 |
| 3,528,047 | A * | 9/1970 | Kazutomo | H01F 17/04 336/136 |
| 4,630,013 | A * | 12/1986 | Takada | H01F 21/08 334/12 |
| 4,725,805 | A * | 2/1988 | Takada | H01F 21/06 336/119 |
| 5,040,239 | A * | 8/1991 | Kondo | H03J 3/16 334/12 |
| 5,559,486 | A * | 9/1996 | Ikenoue | H01F 19/04 336/192 |
| 6,801,113 | B2 * | 10/2004 | Nakazaki | H01F 5/02 324/207.16 |

(Continued)

FOREIGN PATENT DOCUMENTS

| | | |
|---|---|---|
| CN | 101325116 A | 12/2008 |
| CN | 202049853 U | 11/2011 |

(Continued)

OTHER PUBLICATIONS

SIPO First Office Action corresponding to CN Application No. 201611041553.7; dated May 9, 2018.

*Primary Examiner* — Ronald Hinson

(74) *Attorney, Agent, or Firm* — Cantor Colburn LLP

(57) ABSTRACT

A coil part includes: a bobbin including a flange part constituting a winding frame part around which a lead wire is to be wound; a core attached to the bobbin; and a core pressing part which is provided integrally with the flange part, includes a pressing plate part facing the flange part to form a first gap, and presses the core between the flange part and the pressing plate part by inserting at least a part of the core into the first gap.

4 Claims, 7 Drawing Sheets

(56) References Cited

U.S. PATENT DOCUMENTS

| | | | | |
|---|---|---|---|---|
| 8,258,908 | B2 * | 9/2012 | Liao | H01F 27/02 336/192 |
| 2008/0252406 | A1 | 10/2008 | Kitajima et al. | |
| 2011/0115592 | A1 | 5/2011 | Kitajima et al. | |
| 2012/0223641 | A1 | 9/2012 | Chiang et al. | |
| 2014/0109394 | A1 | 4/2014 | Chiang et al. | |
| 2014/0111298 | A1 | 4/2014 | Chiang et al. | |
| 2015/0179331 | A1 | 6/2015 | Su et al. | |

FOREIGN PATENT DOCUMENTS

| | | | |
|---|---|---|---|
| CN | 104392827 | A | 3/2015 |
| JP | 2001143942 | A | 5/2001 |

* cited by examiner

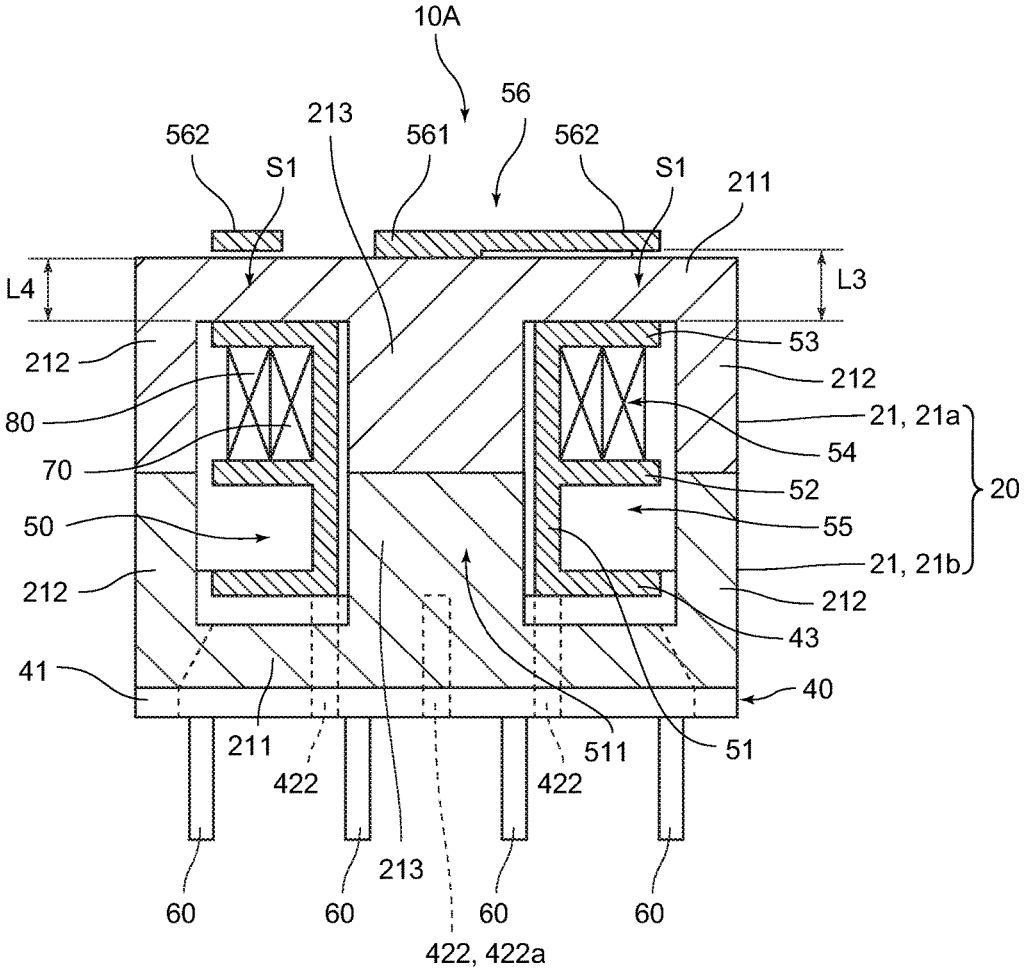
Fig.2
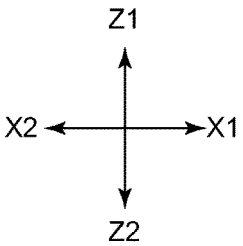

COIL PART AND METHOD OF MANUFACTURING COIL PART

CROSS REFERENCE TO RELATED APPLICATION

This application is based upon and claims the benefit of priority from Japanese patent application No. 2016-033431, filed on Feb. 24, 2016, the disclosure of which is incorporated herein in its entirety by reference.

TECHNICAL FIELD

The present invention relates to a coil part and a method of manufacturing the coil part.

BACKGROUND ART

For example, in coil parts of a transformer or the like, a configuration disclosed in Patent Document 1 exists. In Patent Document 1, a bobbin around which a primary winding and a secondary winding are to be wound exists and a core is attached to the bobbin. The core is attached in a state of going around the bobbin in a vertical direction away from a base, and therefore the core is provided in a manner to cover the bobbin on the upper side (the side farthest from the base) of the bobbin.

[Patent Document 1] Japanese Patent Application Laid-Open No. 2001-143942

SUMMARY OF INVENTION

Technical Problem

In recent years, the coil part of a transformer or the like is increasingly downsized. With the downsizing, the core becomes increasingly thinner, so that the core becomes more easily broken due to a breakage or the like occurring in the core.

Hence, in the configuration disclosed in Patent Document 1, if a breakage occurs, in particular, in the core located on the upper side of the bobbin, the broken core scatters and may cause secondary damage. To prevent such secondary damage, there is a solving method such as covering it by a case or the like. In this case, however, the number of parts increases and downsizing becomes difficult.

The present invention has been made in consideration of the above problem, and its object is to provide a coil part and a method of manufacturing the coil part, which can prevent scattering of a core when the core is broken while suppressing an increase in number of parts.

Solution to Problem

To solve the above problem, in one aspect of the coil part of the present invention, there is provide a coil part including: a bobbin including a flange part constituting a winding frame part around which a lead wire is to be wound; a core attached to the bobbin; and a core pressing part which is provided integrally with the flange part, includes a pressing plate part facing the flange part to form a first gap, and presses the core between the flange part and the pressing plate part by inserting at least a part of the core into the first gap.

Further, in another aspect of the coil part of the present invention, it is preferable, in addition to the above-described invention, that: a pair of the core pressing parts are provided; a second gap into which at least a part of the core is insertable and which communicates with the first gap, is provided between the pair of core pressing parts; an angle in a rotation direction is different between a longitudinal direction of the core inserted in the first gap and the longitudinal direction of the core when the core is inserted in the second gap; and the pair of core pressing parts press the core at different positions in the longitudinal direction of the core.

Moreover, in another aspect of the coil part of the present invention, it is preferable, in addition to the above-described invention, that: the core pressing part includes a supporting post part which projects toward a direction away from a surface of the flange part and supports the pressing plate part; the supporting post part is provided with a holding wall and an insertion guide wall; the holding wall restricts a position in a rotation direction of the core inserted in the first gap; and the insertion guide wall restricts an insertion range of the core into the second gap.

Further, in another aspect of the coil part of the present invention, it is preferable, in addition to the above-described invention, that inner edge parts facing each other of the pair of pressing plate parts are provided to be flush with the insertion guide walls.

Further, according to a second aspect of the present invention, there is provide a method of manufacturing a coil part, including: a winding part formation step of forming a winding part by winding a lead wire around a winding frame part partitioned by a flange part provided at a bobbin; an insertion step of inserting a core into a second gap existing between at least a pair of core pressing parts each of which includes a pressing plate part facing the flange part and is provided integrally with the flange part; after the insertion step, a rotation step of rotating the core to insert the core into the first gap where the flange part and the pressing plate part face each other to press the core between the flange part and the pressing plate part; and after the rotation step, a fixation step of fixing the core to the bobbin.

Advantageous Effects of Invention

According to the present invention, it becomes possible to prevent scattering of a core when the core is broken while suppressing an increase in number of parts.

BRIEF DESCRIPTION OF DRAWINGS

FIG. 2 is a cross-sectional view illustrating a state in which the transformer is cut along a line I-I in FIG. 1;

DESCRIPTION OF EMBODIMENTS

Figure 1:
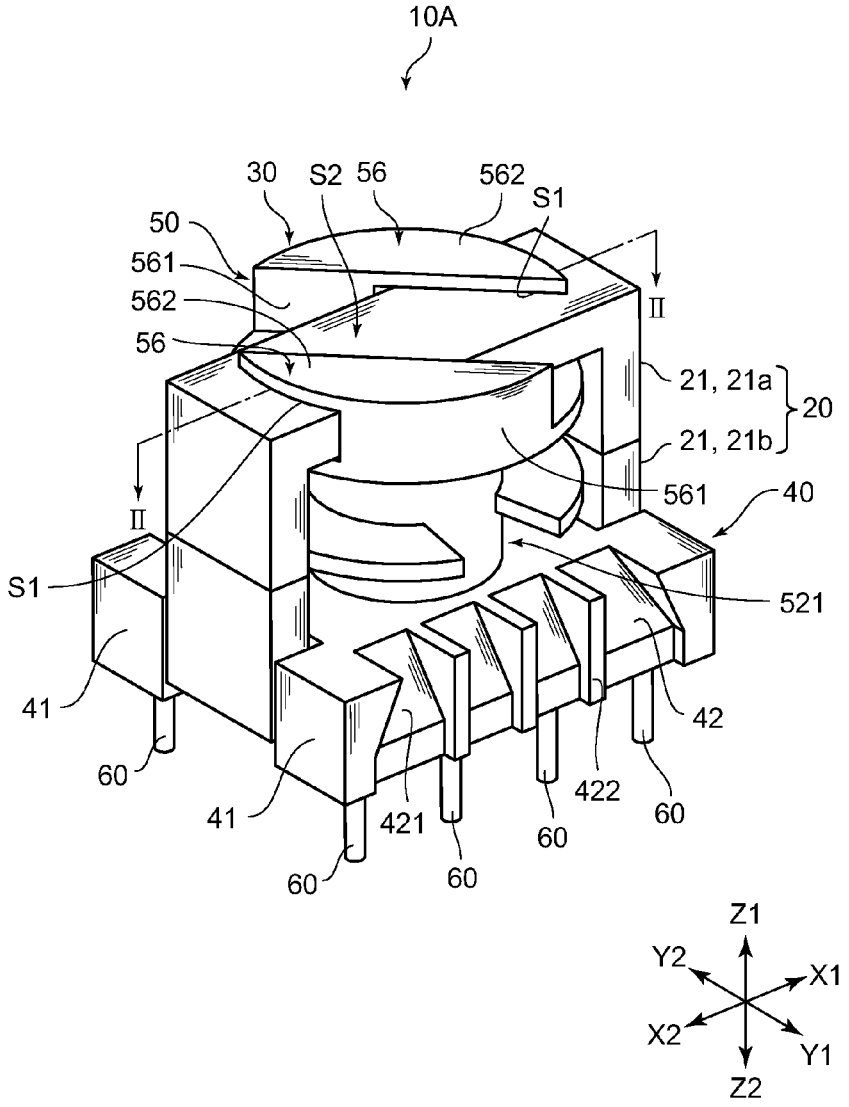
FIG. 1 is a perspective view illustrating the configuration of a transformer according to an embodiment of the present invention, and a view illustrating a state in which a primary winding and a secondary winding are omitted.

Hereinafter, a transformer 10A as a coil part according to an embodiment of the present invention will be described referring to the drawings. Note that in the following description, explanation will be given using an XYZ orthogonal coordinate system in some cases. An X-direction therein is a longitudinal direction of later-described terminal block part 41 and core 21, an X1 side indicates a right side and an upper side in FIG. 1, and an X2 side is a left side and a lower side opposite thereto. A Z-direction is a vertical direction to a substrate on which the transformer 10A is to be mounted, a Z1 side is an upper side in FIG. 1, and a Z2 side is a lower side in FIG. 1. Further, a Y-direction is a direction (a width direction) orthogonal to the X- and Z-directions, a Y1 side is a right side and a lower side in FIG. 1, and a Y2 side is a left side and an upper side opposite thereto.

<Regarding the Whole Configuration of the Transformer 10A>

Figure 3:
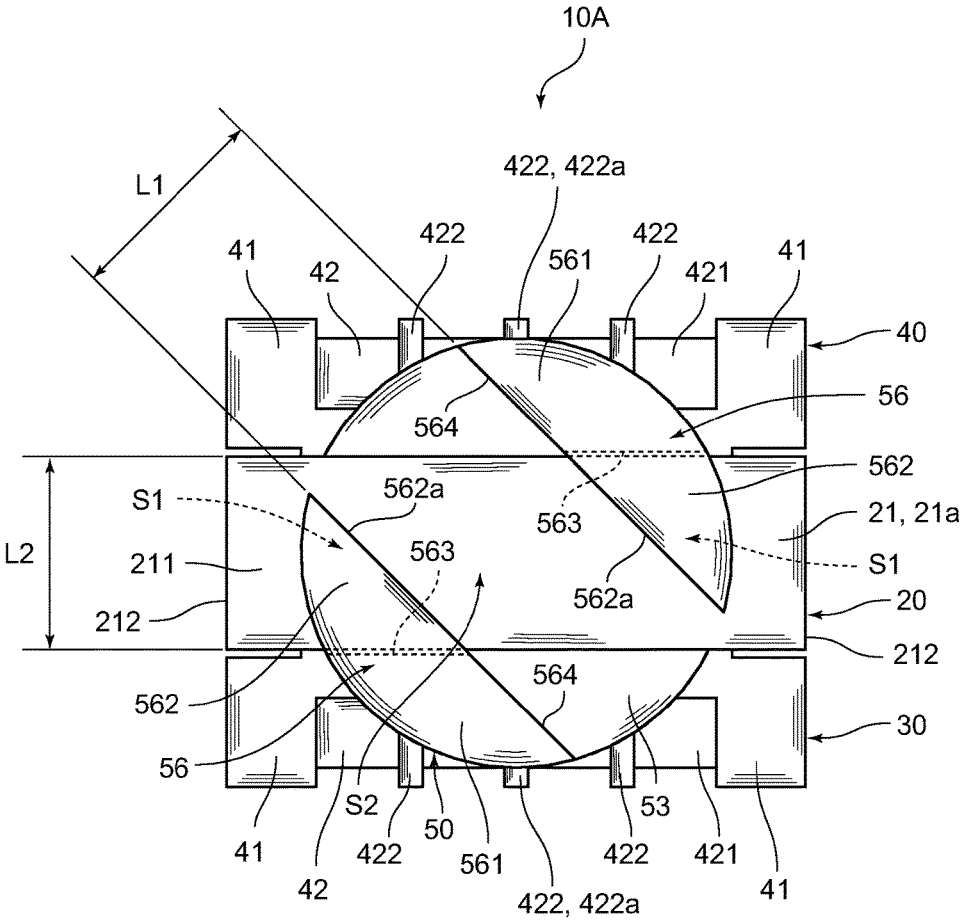
FIG. 3 is a plane view illustrating the configuration of the transformer illustrated in FIG. 1.

FIG. 1 is a perspective view illustrating the configuration of the transformer 10A, illustrating a state in which a primary winding 70 and a secondary winding 80 are omitted. FIG. 2 is a cross-sectional view illustrating a state in which the transformer 10A is cut along a line I-I in FIG. 1. Further, FIG. 3 is a plane view illustrating the configuration of the transformer 10A. The transformer 10A illustrated in FIG. 1 to FIG. 3 has, as main components, a core body 20, a base body 30, terminal members 60, the primary winding 70, and the secondary winding 80.

Figure 4:
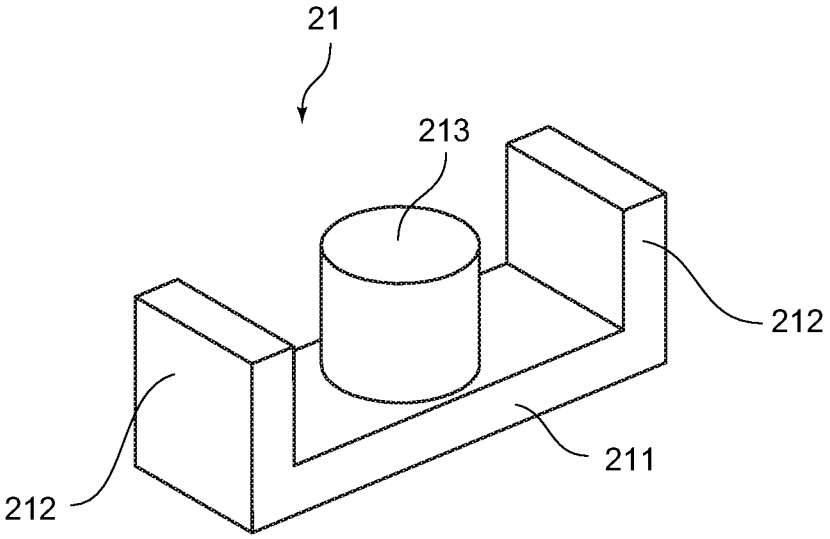
FIG. 4 is a perspective view illustrating the configuration of a core constituting a core body in the transformer illustrated in FIG. 1.

As illustrated in FIG. 1 and FIG. 2, the core body 20 is constituted by bringing a pair of cores 21 into abutment with each other. This configuration of the core 21 is illustrated in FIG. 4. FIG. 4 is a perspective view illustrating the configuration of the core 21 constituting the core body 20. As illustrated in FIG. 4, the core 21 is an E-shaped core having an external appearance in an almost E-shape in this embodiment. This core 21 has outer legs 212 on both ends of a plate-shaped coupling base part 211 respectively, and a middle leg 213 erected between both the outer legs 212. Between the pair of the cores 21, the outer legs 212 are abutted with each other and the middle legs 213 are abutted with each other. The abutment constitutes the core body 20, and the core body 20 constitutes a magnetic path in mutual induction in the primary winding 70 and the secondary winding 80.

Note that the middle legs 213 of the pair of cores 21 are inserted into a later-described hollow part 511 (refer to FIG. 2) of the base body 30, and abutted with each other inside the hollow part 511. Further, in this embodiment, both of the pair of cores 21 have the same shape. However, the pair of cores 21 may have shapes different from each other. In the following description, when it is necessary to distinguish the pair of cores 21 from each other, the core 21 located on the upper side (Z1 side) is referred to as a core 21*a*, and the core 21 located on the lower side (Z2 side) is referred to as a core 21*b*. However, when it is unnecessary to distinguish them from each other, they are referred to simply as the cores 21.

The pair of cores 21 use a magnetic material as their material, and it is possible to use, as the magnetic material, for example, various types of magnetic materials such as ferrite, such as nickel-based ferrite or manganese-based ferrite, permalloy, and sendust, and mixtures of various types of magnetic materials.

Figure 5:
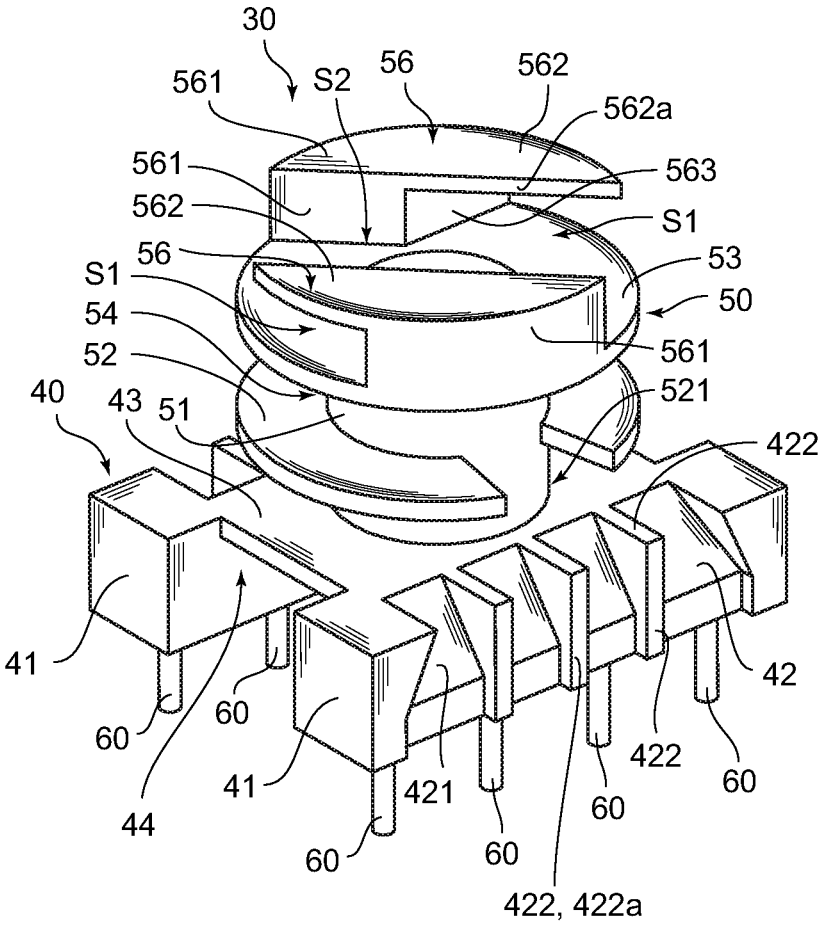
FIG. 5 is a perspective view illustrating the configuration of a base body in the transformer illustrated in FIG. 1.
Figure 5:
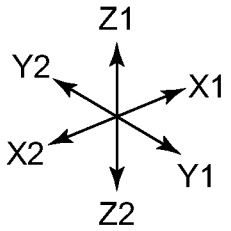

FIG. 5 is a perspective view illustrating the configuration of the base body 30. The base body 30 is formed of a material having an electric insulating property, such as a resin. This base body 30 is provided with a base part 40 and a bobbin part 50. The base part 40 is a portion that supports, at the lower side (Z2 side), the bobbin part 50. The base part 40 is provided with a pair of terminal block parts 41 and a coupling part 43.

The terminal block parts 41 are provided on one side (Y1 side) and the other side (Y2 side) in the width direction (Y-direction) of the transformer 10A respectively across the coupling part 43. The terminal block parts 41 are portions to which the terminal members 60 are attached. More specifically, for example, at the time when the base part 30 is formed, the terminal members 60 are set in a mold and then injection molding is performed, whereby the terminal members 60 are attached to the terminal block parts 41 in a state where portions on the upper side (Z1 side) of the terminal members 60 are embedded in the terminal block parts 41.

The terminal block part 41 is provided with an end guide part 42. The end guide part 42 is a portion for guiding the end of the primary winding 70 or the secondary winding 80 toward the terminal member 60. To improve the guiding property when the end goes toward the terminal member 60, the end guide part 42 has an inclined wall part 421 inclined with respect to the vertical direction, and partition walls 422 continuing along the vertical direction to the lower side of the inclined wall part 421.

The end guide part 42 is further provided with the partition walls 422 for partitioning ends going toward adjacent terminal members 60. As illustrated in FIG. 2, the position where the partition wall 422 exists in the vicinity of any of the terminal members 60. In addition, as illustrated in FIG. 2, at a position in the longitudinal direction (X-direction) of the terminal block part 41, the wall surface of the partition wall 422 is arranged apart from the outer surface of the terminal member 60 by a distance approximately corresponding to the diameter of the end. Therefore, when the end guided by the partition wall 422 goes toward the terminal member 60, the end is brought into a state of being along substantially the width direction (Y-direction), thereby enabling improvement of the positioning property of the end.

Note that a partition wall 422*a* located at a middle portion in the longitudinal direction (X-direction) of the terminal block part 41 among the partition walls 422 is not close to any terminal member 60. However, guiding the end from a winding frame part to the terminal member 60 using (hooking) the partition wall 422*a* makes it possible to prevent the end on the primary winding 70 side from coming into close contact with the end on the secondary winding 80 side.

Further, the coupling part 43 is provided to couple the pair of terminal block parts 41. The coupling part 43 is a plate-shaped portion, and on the upper surface side (Z1 side), the bobbin part 50 is integrally provided.

Further, on the lower surface side (Z2 side) of the coupling part 43 of the base part 40, a core attachment recessed part 44 is also provided. As illustrated in FIG. 5, the core attachment recessed part 44 is a portion for locating the core 21*b* on the lower side (Z2 side) therein, and is located between the pair of terminal block parts 41. Note that it is assumed that the depth of the recess of the core attachment recessed part 44 is from the lower end surface of the terminal block part 41 to the lower surface of the coupling part 43, the depth of the recess is equal to or more than the thickness of the coupling base part 211 of the core 21*b*.

Next, the bobbin part 50 corresponding to a bobbin will be described. As illustrated in FIG. 2 and FIG. 5, the bobbin part 50 is provided with a cylindrical part 51, a lower flange part 52, an upper flange part 53, and core pressing parts 56. The cylindrical part 51 is a portion provided in a hollow cylindrical shape. A hollow part 511 (refer to FIG. 2) of the cylindrical part 51 vertically penetrates the whole of the bobbin part 50 and penetrates also the above-described coupling part 43.

Further, the lower flange part 52 continues to a middle portion in the vertical direction of the cylindrical part 51, and the upper flange part 53 continues to the upper end side (Z1 side) of the cylindrical part 51. Both of the lower flange part 52 and the upper flange part 53 are portions provided to project to an outer periphery side farther than the cylindrical part 51. By being surrounded with the cylindrical part 51, the lower flange part 52 and the upper flange part 53, a winding frame part 54 for positioning the primary winding 70 and the secondary winding 80 is constituted. Note that the upper flange part 53 corresponds to a flange part.

Here, the lower flange part 52 is provided with a guide cutout part 521. The guide cutout part 521 is a portion made by cutting out the lower flange part 52 at a predetermined angle in the circumferential direction to thereby satisfactorily lead out the ends of the primary winding 70 and the secondary winding 80 wound around the winding frame part 54 toward the terminal members 60.

Note that on the lower side of the lower flange part 52, a gap part 55 is provided. It is possible to wind the end of the primary winding 70 or the secondary winding 80 around the gap part 55, and thereby appropriately change the lead-out direction of the end. Note that the gap part 55 may be used as a winding frame part by winding at least one of the primary winding 70 or the secondary winding 80 around the gap part 55.

As illustrated in FIG. 1 to FIG. 3 and FIG. 5, a pair of core pressing parts 56 are provided to project to the upper side (Z1 side) from the upper surface side of the upper flange part 53. The core pressing parts 56 are portions that hold the coupling base part 211 of the core 21*a* located on the upper side (Z1 side), between the upper flange part 53 and the core pressing parts 56. Even when the coupling base part 211 of the core 21*a* is broken due to cracks occurring in the coupling base part 211, the existence of the core pressing parts 56 enable prevention of scattering of broken core fragments.

Further, as illustrated in FIG. 1 to FIG. 3 and FIG. 5, a predetermined gap (a second gap S2) exists between the pair of core pressing parts 56. The second gap S2 is provided to have a width allowing insertion of the core 21*a* thereinto. More specifically, it is assumed that the dimension of the second gap S2 is L1 and the width of the core 21*a* is L2 in the XY plane (refer to FIG. 3), the core pressing parts 56 are provided so that L1≥L2 is satisfied. However, in the case where the core pressing parts 56 are elastically deformed to insert the core 21*a* between pressing plate parts 562 and the upper flange part 53, the dimension L2 may be smaller than the dimension L1.

As illustrated in FIG. 1 to FIG. 3 and FIG. 5, the core pressing part 56 has an arc-shaped outer peripheral wall surface. The core pressing part 56 includes a supporting post part 561 and the pressing plate part 562, and only the supporting post part 561 is connected to the upper flange part 53. More specifically, the pressing plate part 562 does not directly continue to the upper flange part 53, but is supported by the supporting post part 561. In other words, the pressing plate part 562 is in a plate shape having a thickness smaller than the dimension in the height direction of the supporting post part 561. Accordingly, the core 21*a* can enter a gap (a first gap S1) between the pressing plate part 562 and the upper flange part 53.

Note that as illustrated in FIG. 2, it is assumed that the dimension in the height direction (Z-direction) of the first gap S1 is L3 and the thickness (the dimension in the Z-direction) of the coupling base part 211 is L4, the core pressing parts 56 are provided so that L3≥L4 is satisfied. However, in the case where the core pressing parts 56 are elastically deformed to insert the core 21*a* between the pressing plate parts 562 and the upper flange part 53, the dimension L3 may be smaller than the dimension L4 at a stage prior to the insertion of the core 21*a*.

Further, the upper surfaces of the supporting post part 561 and the pressing plate part 562 are provided to be flush with each other. Accordingly, as illustrated in FIG. 3, when viewed from above, the core pressing parts 56 are provided in a shape made by cutting a circle by a straight line (however, in the configuration illustrated in FIG. 3, the arc of the core pressing part 56 is smaller than the arc of a semicircle).

Here, as illustrated in FIG. 5, two planar wall surfaces different in angle exist in each of the supporting post parts 561. Of the wall surfaces, the one along the longitudinal direction (X-direction) of the terminal block part 41 in the XY plane is a holding wall 563, and the one at a predetermined angle with respect to the longitudinal direction (X-direction) of the terminal block part 41 is an insertion guide wall 564. In this embodiment, as is clear from FIG. 3 and FIG. 5 and so on, the angle near the vertex where the holding wall 563 and the insertion guide wall 564 intersect with each other is an obtuse angle. An example of the obtuse angle is more than 90 degrees and 160 degrees or less. However, the angle near the above-described vertex may be 90 degrees or may be less than 180 degrees and 160 degrees or more.

As is clear from FIG. 1 and FIG. 3, the holding wall 563 is a wall surface that closely faces or is in contact with the coupling base part 211 of the core 21*a* in an attached state. Therefore, the holding wall 563 has a function of suppressing rotation of the core 21*a* within the XY plane (positioning in the rotation direction). Further, as illustrated in FIG. 2, the holding wall 563, the upper flange part 53, and the pressing plate part 562 form the first gap S1 which the core 21*a* enters.

Note that as illustrated in FIG. 3, the pair of holding walls 563 do not exit at the same position but at different positions in the longitudinal direction (X-direction) of the terminal block parts 41. In this case, the pair of holding walls 563 may exist at completely different positions or may exist at partially different positions in the longitudinal direction (X-direction) of the terminal block parts 41. Besides, the gap between the pair of holding walls 563 is the same dimension as the above-described dimension L1, but may be a slightly different dimension.

Besides, the pair of insertion guide walls 564 are wall surfaces inclined at a predetermined angle with respect to the longitudinal direction (X-direction) of the terminal block parts 41 as described above. Further, inner edge parts 562*a* of the pressing plate parts 562 are provided to be flush with the insertion guide walls 564. In addition, between the insertion guide wall 564 and the inner edge part 562*a* on one side, and, the insertion guide wall 564 and the inner edge part 562*a* on the other side, the above-described gap S2 exists. When the core 21*a* is attached to the bobbin part 50, the core 21*a* can be first inserted into the second gap S2. Note that the angle of the insertion guide wall 564 with respect to the longitudinal direction (X-direction) of the terminal block part 41 corresponds to the above-described obtuse angle, and an example of the obtuse angle is less than 90 degrees and 20 degrees or more (among them, for example, less than 90 degrees and 30 degrees or more). However, the predetermined angle may be any degrees.

Note that when the angle of the insertion guide wall 564 with respect to the longitudinal direction (X-direction) of the terminal block part 41 becomes larger, the strength of the core pressing part 56 becomes smaller, whereas when the above-described angle becomes smaller, the area for pressing the core 21*a* becomes smaller, resulting in reduction in pressing effect. Here, the dimension in the width direction (Y-direction) of a portion of the pressing plate part 562 pressing the core 21*a* with respect to an oblique side becomes ½ when the above-described angle is 30 degrees. Accordingly, the lower limit of the above-described angle is sometimes 30 degrees, and can be set to an appropriate angle (for example, 35 degrees, 40 degrees, 45 degrees (in the case in FIG. 3), 50 degrees, 55 degrees, 60 degrees or the like) in a range without exceeding 90 degrees.

Note that as illustrated in FIG. 2, around the winding frame part 54, the primary winding 70 and the secondary winding 80 are arranged. Note that at least one of the primary winding 70 and the secondary winding 80 corresponds to a winding part. The primary winding 70 is formed by winding a not-illustrated lead wire. The lead wire is configured such that a conductive portion is covered with an insulating layer, and the end of the lead wire is bound to the terminal member 60.

Further, the secondary winding 80 is also formed by winding a not-illustrated lead wire. Note that FIG. 2 illustrates a state in which the primary winding 70 is first wound around the winding frame part 54 and then the secondary winding 80 is wound around thereon. However, a configuration may be made in which the secondary winding 80 is first wound around the winding frame part 54 and then the primary winding 70 is wound around thereon. Further, the primary winding 70 is first wound, then the secondary winding 80 is wound around thereon, and thereafter the primary winding 70 may be wound again, or the secondary winding 80 is first wound, then the primary winding 70 is wound thereon, and thereafter the secondary winding 80 may be wound again.

<Regarding a Manufacturing Method>

In the case of manufacturing the transformer 10A with the above configuration, the primary winding 70 and the secondary winding 80 are formed on the winding frame part 54 by winding lead wires around the winding frame part 54 (corresponding to a winding part formation step). In this event, the ends of the lead wires are bound to the terminal members 60 respectively, and fixed in a state of electrically conducting between the lead wires and the terminal members 60 by a method such as a soldering or a laser welding.

Thereafter, the core 21*b* on the lower side (Z2 side) and the core 21*a* on the upper side (Z1 side) are attached to the base body 30. In the attachment, an adhesive is applied to portions of the core 21*b* and the core 21*a* (for example, portions where the bobbin part 50 is in contact with the cores 21*a* and 21*b*, portions where the cores 21*a* and 21*b* are abutted with each other, and so on).

In the case where the core 21*a* on the upper side (Z1 side) is attached, the core 21*a* is first inserted into the second gap S2 (corresponding to an insertion step). In this event, the core 21*a* comes into a state of being inclined at a predetermined angle with respect to the longitudinal direction (X-direction) of the terminal block parts 41. Note that the predetermined angle is an angle of, for example, the insertion guide wall 564 with respect to the longitudinal direction (X-direction) of the terminal block parts 41 as described above.

Then, the core 21*a* is rotated so that a part thereof inserted in the second gap S2 is inserted into the first gap S1 (corresponding to a rotation step). Then, the core 21*a* is brought into a state of being along the longitudinal direction (X-direction) of the terminal block parts 41, and brought into a state of being abutted with the core 21*b* arranged on the lower side (Z2 side) without positional deviation.

Thereafter, the cores 21*a*, 21*b* are fixed to the bobbin part 50 by drying or the like the applied adhesive (corresponding to a fixation step). Further, other necessary processing is performed. Thus, the transformer 10A is formed. Further, at the above-described fixation step, the core 21*a* is in a state of being pressed by the core pressing parts 56. Therefore, a jig for pressing the core 21*a* from the upper surface side is unnecessary.

<Regarding Operation and Effect>

The transformer 10A with the above-described configuration includes the bobbin part 50 provided with the upper flange part 53 constituting the winding frame part 54 around which the lead wire is to be wound. The transformer 10A further includes the core 21*a* attached to the bobbin part 50 and the core pressing parts 56, the core pressing parts 56 include the pressing plate parts 562 facing the upper flange part 53 to form the first gap S1, and at least a part of the core 21*a* is inserted into the first gap S1 so that the core 21*a* can be pressed between the upper flange part 53 and the pressing plate parts 562.

Therefore, in the transformer 10A, it becomes possible to prevent, when the core 21*a* is broken, scattering of the broken core 21*a* and its broken portions while suppressing an increase in number of parts. This prevents occurrence of secondary damage due to the scattering of the broken core 21*a* and broken portions. In particular, when the transformer 10A is increasingly downsized, the core 21*a* becomes more likely to be broken. However, the secondary damage can be satisfactorily prevented even in such a transformer 10A.

Further, the core pressing parts 56 are integrally provided with the bobbin part 50. This makes it possible to prevent an increase in number of parts of the transformer 10A. More specifically, it is conceivable to house the core 21 in a case or the like so as to prevent scattering of the broken core 21*a* and its broken portions when the core 21*a* is broken. However, in this embodiment, it becomes possible to prevent scattering of the broken core 21*a* and its broken portions without needing a separate part such as the case or the like.

Further, in this embodiment, the pair of core pressing parts 56 are provided and the second gap S2 communicating with the first gap S1 is provided between the pair of core pressing parts 56, and at least a part of the core 21*a* can be inserted into the second gap S2. Further, the longitudinal direction of the core 21*a* inserted in the first gap S1 and the longitudinal direction of the core 21*a* inserted in the second gap S2 are different in angle in the rotation direction. Further, the pair of core pressing parts 56 press the core 21*a* at different positions in the longitudinal direction (X-direction) of the core 21*a*.

Therefore, by inserting the core 21*a* first into the second gap S2 and then rotating the core 21*a* so as to insert the core 21*a* into the first core S1, a configuration can be made in which the core 21*a* is pressed by the pair of core pressing parts 56 without needing so many man-hours.

Furthermore, in this embodiment, the core pressing part 56 has the supporting post part 561, and the supporting post part 561 projects toward a direction (vertical direction; Z-direction) away from the surface of the upper flange part 53 and supports the pressing plate part 562. The supporting post part 561 is provided with the holding wall 563 and the insertion guide wall 564. Of them, the holding wall 563 restricts the position in the rotation direction of the core 21*a* inserted in the first gap 51, and the insertion guide wall 564 restricts an insertion range of the core 21*a* into the second gap S2.

The holding wall 563 and the insertion guide wall 564 exist as described above can improve the guiding property and the positioning property when attaching the core 21*a* on the upper side (Z1 side) to the bobbin part 50. Therefore, the productivity of the transformer 10A can be improved.

Further, in this embodiment, the inner edge parts 562*a* facing each other of the pair of pressing plate parts 562 are provided to be flush with the insertion guide walls 564. This further facilitates insertion of the core 21*a* into the second gap S2, thereby enabling further improvement in productivity of the transformer 10A.

Further, in this embodiment, the winding part (the primary winding 70, the secondary winding 80) is formed at the winding part formation step, and then the core 21*a* is inserted into the second gap S2 at the insertion step. Further, at the rotation step, the core 21*a* is rotated to enter the first gap S1 where the upper flange part 53 and the core pressing parts 56 face each other. After the rotation step, the core 21*a* is fixed to the bobbin part 50 at the fixation step.

Therefore, in the case of manufacturing the transformer 10A, a separate member (tape, case, cover or the like) for pressing the core 21*a* becomes unnecessary, thereby enabling a reduction in cost required for production of the transformer 10A and improvement in production. Further, at the fixation step, a state in which the core 21*a* is pressed by the core pressing parts 56 is established, thereby making it possible to eliminate the need for the jig for pressing the core 21*a* from the upper surface side to thereby further improve the productivity of the transformer 10A.

Modification Examples

The embodiment of the present invention has been described above, the present invention can be variously modified other than this. Hereinafter, they will be described.

Figure 6:
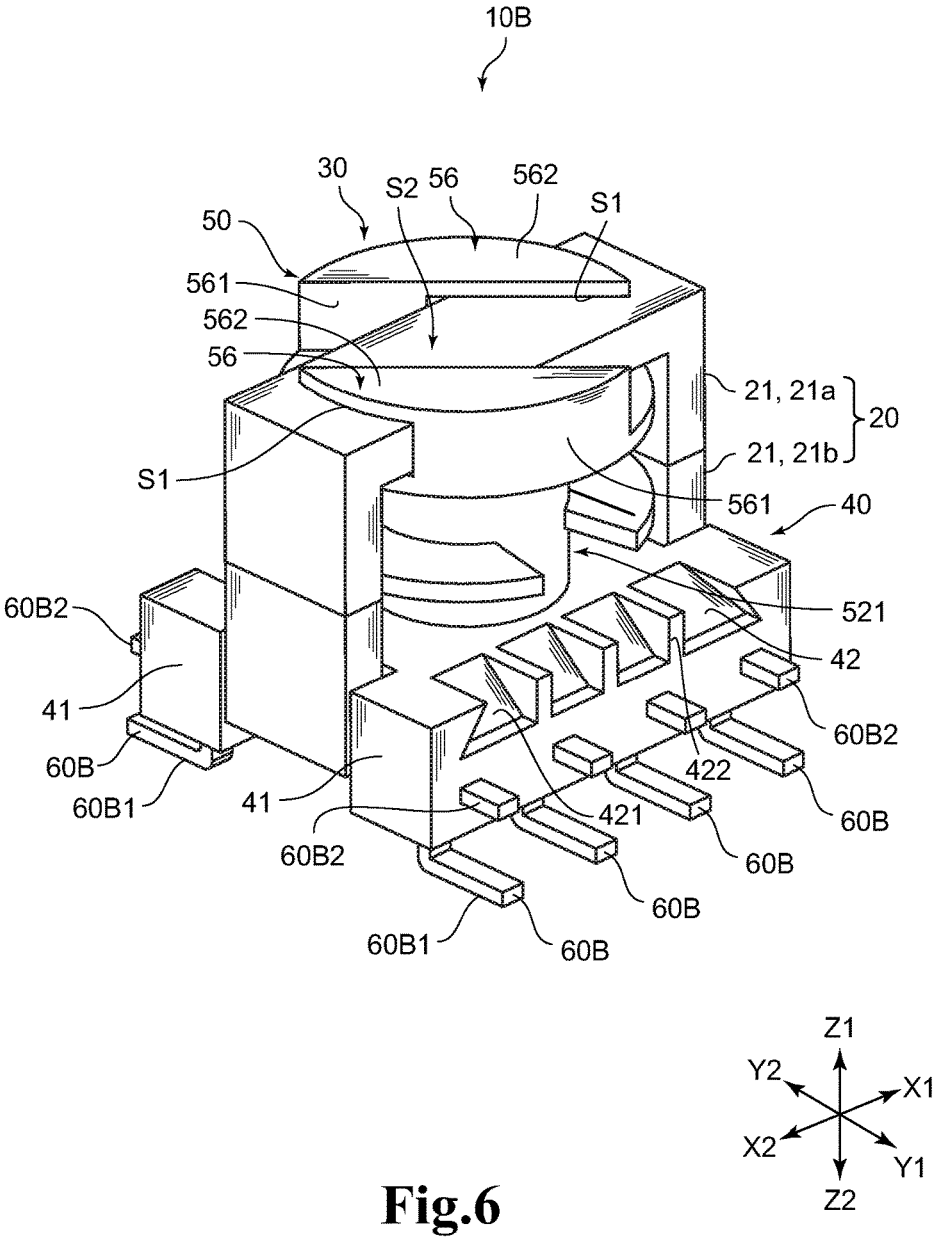
FIG. 6 is a perspective view illustrating the configuration of a transformer according to a modification example of the present invention, and a view illustrating a state in which a primary winding and a secondary winding are omitted.

In the above-described embodiment, the terminal member 60 is a pin-type pin terminal and is configured to be inserted into a hole portion of a printed circuit board on which the transformer 10A is to be mounted. However, the terminal member may be the one other than the pin terminal. A transformer with such a configuration is illustrated in FIG. 6. In a transformer 10B illustrated in FIG. 6, a configuration is disclosed in which terminal members 60B are provided in place of the terminal members 60 illustrated in FIG. 1 and FIG. 5. The terminal member 60B includes a mounting part 60B1 that comes into contact with a mounting portion of the printed circuit board on which the terminal member 60B is to be mounted, in a state of being parallel with or almost parallel with the mounting portion. The mounting part 60B1 is electrically connected to the mounting portion by a method such as a soldering or a laser welding.

The terminal member 60B further includes a binding terminal part 60B2 located on the upper side (Z1 side) than the mounting part 60B1. The mounting part 60B1 and the binding terminal part 60B2 are portions that exist in one terminal member 60B and extend from the inside of the terminal block part 41. The binding terminal part 60B2 is a portion to which the end of the lead wire of the primary winding 70 or the end of the lead wire of the secondary winding 80 is to be bound. Note that the bound end is fixed in a state of electrically conducting with the terminal member 60B by a method such as a soldering or a laser welding.

Figure 7:
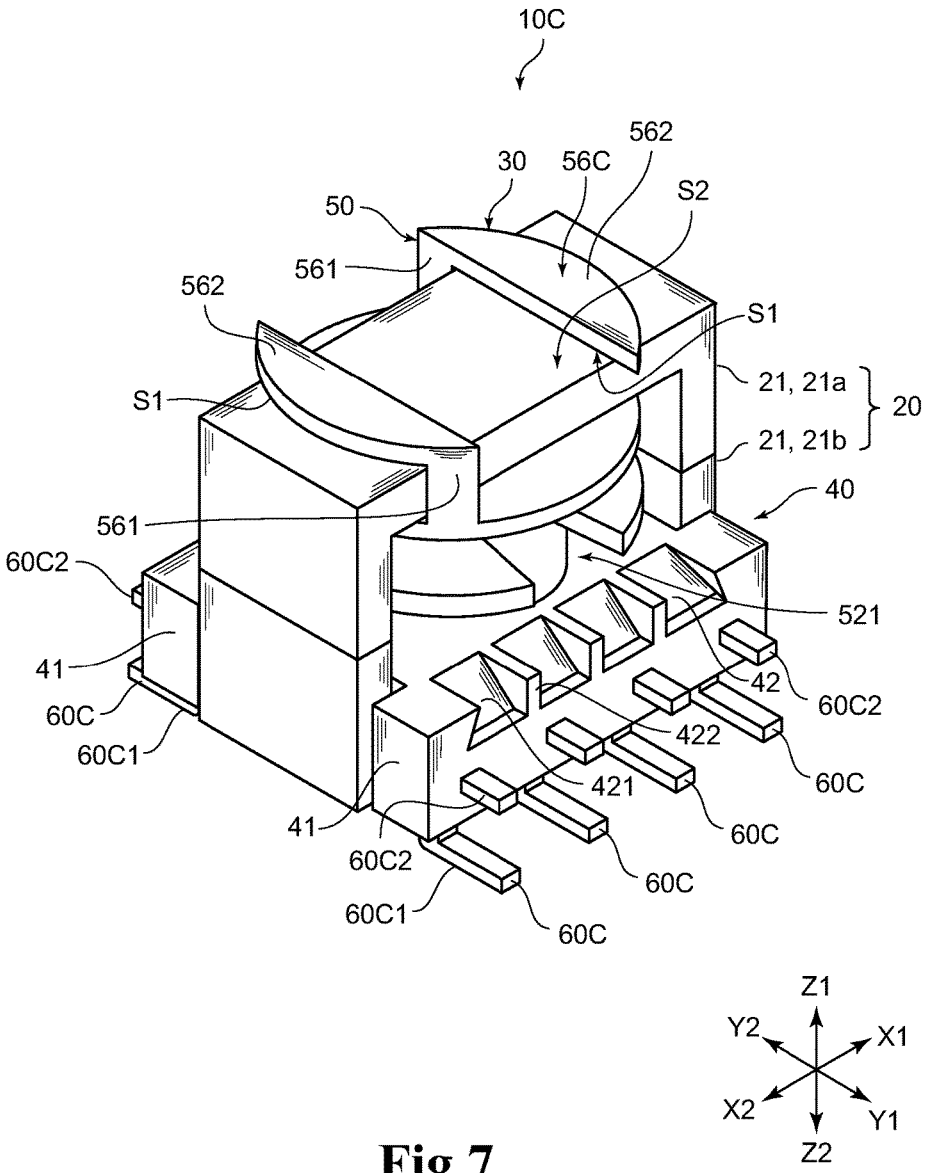
FIG. 7 is a perspective view illustrating the configuration of a transformer according to another modification example of the present invention, and a view illustrating a state in which a primary winding and a secondary winding are omitted.

Further, in the above embodiment, the transformer 10A is provided such that the extending directions of the insertion guide wall 564 and the inner edge parts 562*a* are inclined with respect to the longitudinal direction (X-direction) of the terminal block parts 41. However, in place of such a configuration, for example, a configuration as illustrated in FIG. 7 may be employed. A transformer 10C illustrated in FIG. 7 includes core pressing parts 56C different from the core pressing parts 56 illustrated in FIG. 1. The transformer 10C further includes terminal members 60C similar to the terminal members 60B illustrated in FIG. 6. The terminal member 60C includes a mounting part 60C1 similar to the mounting part 60B1, and also includes a binding terminal part 60C2 similar to the binding terminal part 60B2.

The core pressing parts 56C are provided such that the extending directions of holding walls 563C (illustration of the holding walls 563C is omitted in FIG. 7) are along the longitudinal direction (X-direction) of the terminal block parts 41. Further, in the configuration illustrated in FIG. 7, by inserting the core 21*a* on the upper side (Z1 side) into the second gap S2 and then rotating the core 21*a* by about 90 degrees, the core 21*a* can enter the first gap S1.

Comparing the transformer 10A illustrated in FIG. 1 with the transformer 10C illustrated in FIG. 7, in the transformer 10C illustrated in FIG. 7, though the dimension in the circumferential direction of the supporting post parts 561 becomes shorter, the pressing plate parts 562 come into a state of covering the core 21*a* in a relatively large area in the entire width direction (Y-direction), thereby stably holding the core 21*a*. On the other hand, in the transformer 10A illustrated in FIG. 1, the length in the circumferential direction of the supporting post parts 561 can be made longer. Accordingly, the transformer 10A can be configured such that the supporting post parts 561 are hard to be broken when an external stress of moving upward the core 21*a* is applied thereon.

Further, the configuration illustrated in FIG. 7 can easily realize a configuration in which the side of the pressing plate part 562 opposite to the supporting post part 561 projects outside the core 21*a*. Therefore, it is also possible to realize a configuration in which a projection projecting to the lower side (Z2 side) is provided at a portion of the pressing plate part 562 projecting from the core 21*a*. In this case, when the core 21*a* is fitted in the first gap S1, a configuration similar to a snap fit mechanism can be realized. Further, once the core 21*a* is fitted in the first gap S1, the core 21*a* is configured to be hard to get out of the fitted state, and can be further stably held. Note that the configuration similar to the snap fit mechanism may be applied to the transformer 10A in FIG. 1, the transformer 10B in FIG. 6, or other coil parts as a matter of course.

Further, in the above-described embodiment, by inserting the core 21*a* on the upper side (Z1 side) into the second gap S2 and then rotating the core 21*a*, the core 21*a* is inserted into the first gap S1. However, the core 21*a* may be inserted into the first gap S1 by sliding the core 21*a* on the upper side (Z1 side). In this case, for example, in the configuration illustrated in FIG. 1, the supporting post part 561 can be brought into a state of locating on any one side in the extending directions of the insertion guide wall 564 and the inner edge part 562*a*.

Further, in the above embodiment, in the base body 30, the base part 40 and the bobbin part 50 are integrally constituted. However, the base part 40 and the bobbin part 50 may be separately constituted.

Besides, in the above embodiment, the core attached to the bobbin part 50 is the E-type core. However, the core is not limited to the E-type core. For example, a core body may be configured by combining cores each having external appearance in an almost U-shape, or a core body may be configured by combining cores each having external appearance in an almost I-shape.

Besides, in the above embodiment, the transformer 10A is described as the coil part. However, the coil part is not limited to the transformer 10A, and the present invention may be applied to, for example, other coil parts such as an inductor and the like.

Besides, in the above embodiment, a pair of coils are used, but the present invention may be applied to a case of using only one core, and the present invention may be applied to a case of using three or more cores in combination.

The invention claimed is:

1. A coil part, comprising:

a bobbin comprising a flange part constituting a winding frame part around which a lead wire is to be wound;

a core attached to the bobbin; and a core pressing part which is provided integrally with the flange part, comprises a pressing plate part facing the flange part to form a first gap, and presses the core between the flange part and the pressing plate part by inserting at least a part of the core into the first gap.

2. The coil part according to claim 1, wherein:

a pair of the core pressing parts is provided;

a second gap into which at least a part of the core is insertable and which communicates with the first gap, is provided between the pair of core pressing parts;

an angle in a rotation direction is different between a longitudinal direction of the core inserted in the first gap and the longitudinal direction of the core when the core is inserted in the second gap; and the pair of core pressing parts presses the core at different positions in the longitudinal direction of the core.

3. The coil part according to claim 2, wherein:

the core pressing part comprises a supporting post part which projects toward a direction away from a surface of the flange part and supports the pressing plate part;

the supporting post part is provided with a holding wall and an insertion guide wall;

the holding wall restricts a position in a rotation direction of the core inserted in the first gap; and the insertion guide wall restricts an insertion range of the core into the second gap.

4. The coil part according to claim 1, wherein a pair of the pressing plate parts is provided; and inner edge parts facing each other of the pair of pressing plate parts are provided to be flush with the insertion guide walls.

* * * * *